US008840211B2

(12) United States Patent
Gargir et al.

(10) Patent No.: US 8,840,211 B2
(45) Date of Patent: Sep. 23, 2014

(54) BIMODAL INK JET PRINTING METHOD

(76) Inventors: Eyal Gargir, Kfar Saba (IL); Yaron Bar-Tal, Ganei Tikveh (IL); Hanan Yosefi, Ganei Tikveh (IL)

( * ) Notice: Subject to any disclaimer, the term of this patent is extended or adjusted under 35 U.S.C. 154(b) by 0 days.

(21) Appl. No.: 14/118,079

(22) PCT Filed: May 1, 2012

(86) PCT No.: PCT/IL2012/000175

§ 371 (c)(1),
(2), (4) Date: Dec. 5, 2013

(87) PCT Pub. No.: WO2012/156961

PCT Pub. Date: Nov. 22, 2012

(65) Prior Publication Data

US 2014/0132675 A1 May 15, 2014

Related U.S. Application Data

(60) Provisional application No. 61/486,787, filed on May 17, 2011.

(51) Int. Cl.

| | |
|---|---|
| ***B41J 2/205*** | (2006.01) |
| ***B41J 2/21*** | (2006.01) |
| ***B41J 2/14*** | (2006.01) |
| ***B41J 2/045*** | (2006.01) |

(52) U.S. Cl.

CPC ..... *B41J 2/14201* (2013.01); *B41J 2/2128* (2013.01); *B41J 2/0458* (2013.01); *B41J 2/04581* (2013.01); *B41J 2/04593* (2013.01)

USPC ..... 347/15; 347/41; 347/9; 347/37

(58) Field of Classification Search

CPC .. B41J 2/14201; B41J 2/04593; B41J 2/2052; B41J 2/2054; B41J 2/2121; B41J 2/2135; B41J 2/21

USPC ..... 347/9, 15, 37, 41, 68, 70, 71

See application file for complete search history.

(56) References Cited

U.S. PATENT DOCUMENTS 6,663,212 B2 * 12/2003 Kojima ..... 347/17

* cited by examiner

*Primary Examiner* — Juanita D Jackson
(74) *Attorney, Agent, or Firm* — Robert G. Lev

(57) ABSTRACT

A method of increasing a dynamic range of grey-scale printing by a first print head of a drop on demand inkjet printer, the first print head having a droplet orifice, the method comprising in addition to selectively supplying no signal for not ejecting a drop of ink, or a first signal for ejecting a first droplet size, further comprises optionally supplying a second signal for ejecting a second droplet size.

14 Claims, 4 Drawing Sheets

BIMODAL INK JET PRINTING METHOD

PRIORITY INFORMATION

This National Stage application claims priority to U.S. Provisional Patent Application No. 61/486, 787 filed on May 17, 2011, and PCT Application No: PCT/IL2012/000175 filed on May 1, 2012.

FIELD OF THE INVENTION

The present invention relates to inkjet printing, and more particularly to a method of drop on demand inkjet printing with varying print intensity over a broad range.

BACKGROUND

Digital printing allows rapid printing of text and graphics. The major benefit of digital printing is that it allows the rapid conversion of computer files (soft) into (hard) printed product. Unlike conventional printing using plates, digital printing is particularly economical for printing individual articles and for short print runs.

Digital printing is usually achieved by 'rastering', i.e. scanning a print-head back and forth, over a print medium.

One digital printing technique is known as inkjet printing Inkjet printing uses a print head equipped with at least one orifice or nozzle through which droplets of a liquid ink are ejected. Typically, an inkjet head is equipped with an array of orifices for selectively ejecting a plurality of droplets. The printer is configured to eject droplets of ink through the orifices in response to signals from a microcomputer or other controller. Digital printing is used for both monochrome and full colored printing, and also for niche applications such as printing conductive inks for electronic applications, and for printing polymer based inks for creating texture.

Monochrome printing uses one ink color, typically black. Full color printing uses at least the three primary ink colors: magenta (M), cyan (C), and yellow (Y); and usually uses four ink colors, further including black (K). Occasionally, printing may use a specialized color scheme, such as a set of inks with light colors e.g. CMYK LcLmLyLk or, CMYK plus one or more additional spot or specialized color, or any other combinations of inks, spot or specialized inks, such as white ink or gold ink for example. A full color inkjet head thus typically includes at least three separate arrays of orifices; each array of orifices being coupled to a reservoir of ink of a different color. The print head further includes a means for jetting the ink, i.e. for forcing it through the orifices and onto the medium to be printed. Jetting techniques are discussed in more detail below.

In addition to printing colors onto a substrate or medium such as paper, because of the versatility and resolutions obtainable, inkjet printers are used for a wide range of applications, and may print onto a wide range of media. Thus inkjet printers are used for printing patterns onto ceramic tiles for application to walls and floors, such as faux-marble, and printing faux-wood in artificial veneers and parquet floor panels.

In addition to printing regular black and colored inks, inkjet printing may be used for specialized printing purposes, such as printing photo-resists, metallic conducting lines and electronic components onto printed circuit boards (PCBs) and other electronic substrates.

Polymers may be printed onto card to give a raised texture. Indeed, photopolymer jetting may be used for rapid prototyping.

To print onto a print medium such as paper, plastic, wood, aluminum, glass, ceramic tiles, fabric and the like, the inks are ejected or "jetted" from the print head, typically whilst the print head is rastered back and forth over the print medium to print across the medium. Some inkjet printers are 'two-way' printers, and eject ink whilst rastering in both the left-to-right direction and in the right-to-left direction. Other systems print in only one direction and are known as One-way' printers.

Printing consists of jetting a side-to-side raster line comprising a series of dots onto the printing medium in what is sometimes referred to as the "fast scan" direction. Printing is achieved along the medium in what is sometimes known as the "slow scan" direction by either advancing the medium past the print head track, or the print head track is moved along the medium between passes.

The printed image produced by inkjet printing techniques typically consists of closely aligned rows of dots. The human eye is able to see a printed dot that is about 25 micrometers in diameter. However, an array of such dots forms a continuous image since the eye is unable to resolve the individual dots. Similarly, closely spaced dots of different colors are indistinguishable individually, and, in this manner, ink jetted printing of the three or four primary printing colors (with or without black) may provide a wide range of shades (hues) and blended colors, each of which is determined by the respective proportions of the primary colors of which it is composed.

In order to achieve a high quality printed image, not just the proportions but also the absolute amount of each color deposited in a given area is variable over a number of different intensity levels. The different intensity levels are sometimes known as 'grey scale', 'dynamic range' or 'dynamic depth'.

In general, the drive controllers for the precise movement and location of the print heads in the fast scan direction (where applicable) and in the slow scan direction are based on programmable hardware.

In droplet on demand (DOD) inkjet printing, the inkjet print head consists of ejection chambers of ink that are coupled via feeder conduits to reservoirs of ink that may be integral to the print head and may raster with the ink head, or may be off axis and stationary. The principal types of DOD printers are valve-jet, piezoelectric, thermal (or bubble jet), and hot-melt ink printers. Two technologies described herein are piezoelectric and thermal.

In piezoelectric DOD inkjet printing, the ejection chambers are equipped with piezoelectric transducers and orifices. Signals from a controller cause the piezoelectric transducers to change their shape, applying pressure on the ink in the ejection chamber and forcing a column of ink through the orifices. The column of ink breaks into droplets.

In thermal DOD inkjet printing, a small volume of ink in the ejection chamber is superheated to vaporization temperature. A bubble of vapor forms within the ejection chamber. The bubble stimulates a fluid-pressure impulse. The impulse forces an ink droplet out of the chamber through the orifices. The upper limit for the firing frequency is determined by the overheating and fluid refill characteristics of the chamber. Firing chamber densities may currently reach a maximum resolution of 600 dots per inch (dpi) with a single pass of the print head. For most applications, 600 dpi provides acceptable text and graphics quality. Higher-quality printing is achieved with several passes of the print head, but at a cost of reduced printing speed.

In contrast to thermal inkjet, the piezoelectric inkjet print head is permanent.

Typical drop ejection frequencies are 36 kHz and can reach 100 kHz. Typical drop volumes range from 2 pL to 50 pL. Typical velocities are 10 to 15 m/s. And a typical head-to-media spacing is 1-3 mm.

The demand for high print quality is constantly growing. To enable high output, it may be useful to be able to print at high resolution with a large dynamic range (grayscale) using wide format or ultra-wide format printers.

The simplest digital printing method, known as binary printing, has two possible grey levels at each pixel point: drop or no drop; signified by 1 and 0, respectively.

In inkjet printing, the ink may be ejected through the orifice by applying a potential difference, using a pulse. The prior art includes methods that attempt to enhance the speed, grey scale and resolution capabilities of inkjet printing.

U.S. Pat. No. 7,673,965 to Mills et al. titled "Apparatus and methods for full-width wide format inkjet printing" describes using a plurality of inkjet printing heads disposed in a print head array for printing an image on a substrate at native resolution across the entire width of the substrate without scanning across the width of the substrate (abolishing fast scan). Hence the scanning time is reduced but a large number of print heads is required. However, the plurality of print heads leads to an increase in cost, a reduction in reliability and a maintenance burden.

U.S. Pat. Nos. 7,591,534, 7,588,316, and 7,585,050 to Silverbrook all refer to an increased number of nozzles with a large number of CMOS controlled print heads that supposedly improves the resolution of the resulting printing. These patents as well as several others by Silverbrook are based on a unique design of CMOS IC print heads which differs from the commonly used and popular piezoelectric print head design. However, the design has been found to be sensitive and fragile.

In U.S. Pat. No. 6,193,347 to Askeland et al., multi drop and multi pass principles are described, where a dot is created by accumulated and overlapping ink drops, thus increasing resolution.

U.S. Pat. No. 6,779,861 to Mori describes an arrangement of injecting orifices, permitting the use of smaller ink drops and a higher apparent print resolution.

The notion of two or more drop sizes that can be used to create a so-called "super pixel" providing an increased number of grey levels has been mentioned in US Patent Application Number 2002/0105557 and earlier in "Printer Handbook", M. L. Chambers, IDG books, 2nd edition, 2000, chapter 3.

U.S. Pat. No. 7,152,946 to Desie, proposes a two-drop-size principle that may be used to enable grey level enhancement. Each print head has orifices of fixed and varying sizes, reflecting the sizes of the resulting drops. In a particular configuration, each print head has orifices of two different sizes. The method also includes controlling the drop size by drop firing at two frequencies. The grey scale is further enhanced by dithering. Desie's approach requires setting the diameter of print head/nozzles in advance.

SUMMARY OF THE INVENTION

A first aspect of the invention is directed to providing a method of increasing a dynamic range of grey-scale printing by a first print head of a drop on demand inkjet printer, the first print head comprising a container containing a volume of a first color of ink and having a droplet orifice, the method comprising in addition to selectively supplying no signal for not ejecting a drop of ink, or a first signal for ejecting a first droplet size, further comprises optionally supplying a second signal for ejecting a second droplet size.

In some embodiments, the first print head comprises a first piezoelectric transducer configured to selectively apply pressure to the volume of a first color of ink in the first container for forcing ink through the droplet orifice; the method comprising in addition to selectively applying a first signal comprising a voltage pulse to the piezoelectric transducer to selectively eject a first drop having a first droplet size, further comprises selectively applying a second signal for applying a second transformation to the piezoelectric transducer, thereby ejecting a second droplet size via the same orifice.

Optionally, the first signal is a first voltage deviation applied to the current supplied to the heating element and the second signal is a second voltage deviation superimposed on the first voltage deviation.

An average first droplet range may be significantly different than an average second droplet range.

The inkjet printer may comprise n print heads for printing m colors of ink such that m is less than or equal to n.

In one embodiment, the inkjet printer comprises 2 print heads and the inkjet printer is configured to print two colors.

In one embodiment, a plurality of voltage pulses to the second transducer ejects a plurality of droplet sizes.

In one embodiment, the inkjet printer further comprises a third print head for printing a third color of ink such that the inkjet printer is configured to print three colors.

The three colors may be yellow magenta and cyan, for example.

The inkjet printer may further comprise a fourth print head for printing a fourth color of ink such that said inkjet printer is configured to print yellow, magenta, cyan and black, for example.

Optionally, the first inkjet print head is configured to selectively eject a first size drop on rastering from left to right across the medium and to selectively eject a second size drop on rastering from right to left across the medium.

Optionally, more than two voltage pulses may be applied to a print head for printing more than two droplet sizes.

Optionally, the second voltage deviation has a reversed polarity to the first voltage deviation and the second droplet size is smaller than the first drop size.

Optionally, the second voltage deviation has a common polarity with the first voltage deviation and the second droplet size is smaller than the first droplet size.

In some embodiments, the first print head comprises a heating element configured to selectively vaporize and thus apply pressure to the volume of a first color of ink in the first container for forcing ink through the droplet orifice; the method comprising in addition to selectively applying a first signal comprising a current pulse to the piezoelectric transducer to selectively eject a first drop having a first droplet size, further comprises selectively applying a second current pulse for applying a second transformation to the piezoelectric transducer, thereby ejecting a second droplet size via the same orifice.

Optionally, the first signal is a first voltage deviation applied to the current supplied to the heating element and the second signal is a second voltage deviation superimposed on the first voltage deviation.

Optionally, the second voltage deviation has a reversed polarity to the first voltage deviation and a smaller current is supplied to the heating element and the second droplet size is smaller than the first drop size.

Optionally, the second voltage deviation has a common polarity with the first voltage deviation and a larger current is supplied to heating element and the second droplet size is smaller than the first droplet size.

Optionally, in some embodiments, the first droplet size varies over a first size distribution and the second droplet size varies over a second size distribution, wherein a distribution of drop sizes ejectable through the orifice is bimodal.

A second aspect of the invention is directed to providing a method of varying the size of a drop ejectable through an orifice of a drop-on-demand inkjet print head comprising a piezoelectric transducer or a heating element for selectively applying pressure to a volume of ink behind an orifice, the method comprising applying a signal to the transducer or the heating element selected from a plurality of signals.

Optionally, the inkjet printer comprises a piezoelectric transducer and varying of the voltage pulse comprises selectively applying a voltage pulse wherein the voltage pulse is selectable from a range of voltage pulses.

Optionally, the range of voltage pulses comprises a discrete number of discrete voltage pulses for ejecting a discrete range of discrete drop sizes.

Optionally, the voltage pulses in the discrete range of voltage pulses are created by superimposing additional voltage pulses onto a first voltage pulse.

A third aspect of the invention is directed to providing an improved method of printing with a drop-on-demand inkjet print head comprising a volume of ink in a container having an orifice and an ejecting means for ejecting the ink through the orifice, wherein the improvement comprises selectively applying one of a plurality of voltage signals to the ejecting means for applying one of a plurality of ejecting pressures for ejecting one of a plurality of drop sizes.

In one example, the ejecting means may comprise a piezoelectric transducer and the one of a plurality of voltage signals induces one of a plurality of shape changes to the piezoelectric transducer for ejecting one of a plurality of droplet sizes.

In another example, the ejecting means comprises a heating element and the one of a plurality of voltage signals induces one of a plurality of current pulses through the heating element for creating one of a plurality of ink pressures for ejecting one of a plurality of droplet sizes.

Optionally, the one of a plurality of drop sizes comprises two drop sizes.

Optionally, the drop on demand inkjet printer is a wide format inkjet printer.

Optionally the drop on demand inkjet printer is an extra wide format inkjet printer.

In some embodiments, different drop sizes are applied to different areas of the medium being printed.

In some embodiments, different print heads on a common carriage are configured to eject different droplet sizes.

In some applications, the ink is a conductive ink.

In some applications, the ink is a photosensitive polymer.

The term print medium as used herein refers to the substrate that is printed onto. Examples of media include paper, card, various plastic materials, metal, wood, but also ceramic tiles, and other substrates.

The term ink as used herein refers to a fluid composition for marking the print medium.

The term droplet is substantially synonymous with drop, and refers to a little drop.

BRIEF DESCRIPTION OF THE DRAWINGS

Embodiments will be understood and appreciated more fully from the following detailed description taken in conjunction with the drawings in which.

DETAILED DESCRIPTION OF THE INVENTION

Figure 1:
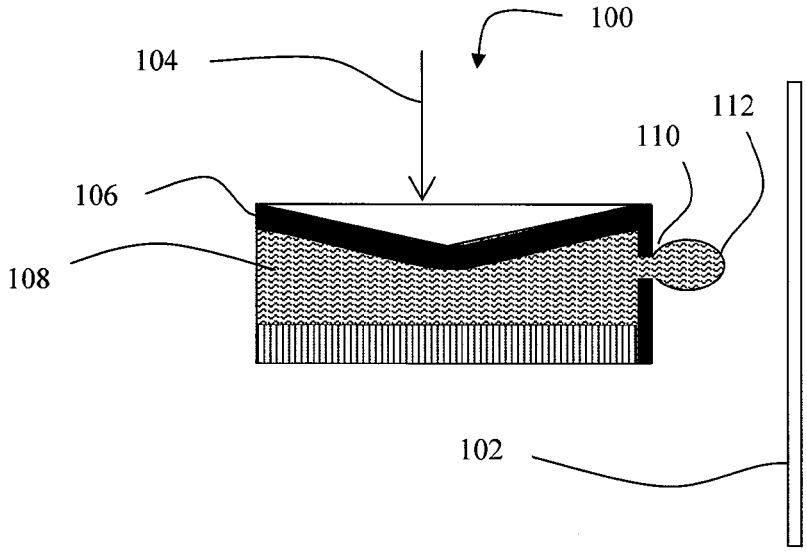
FIG. 1 is a schematic illustration of a print head for Drop-On-Demand (DOD) piezoelectric printing.
Figure 2:
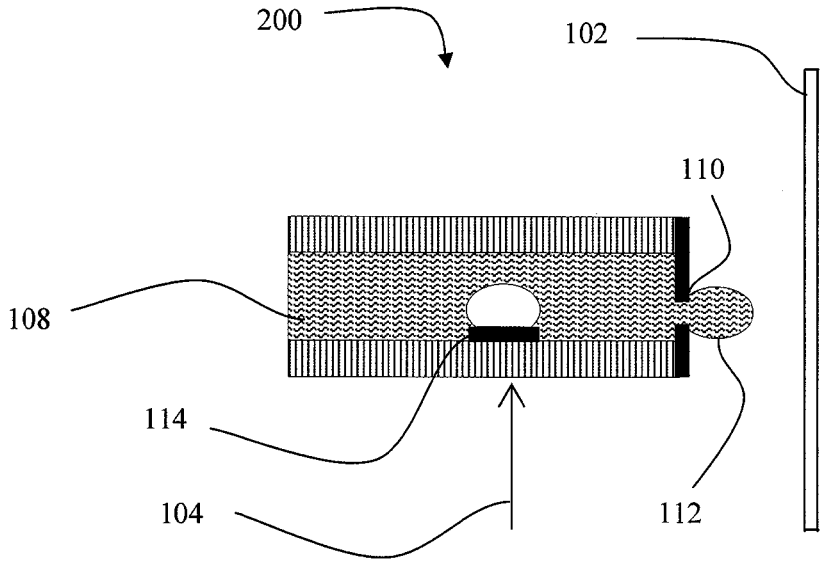
FIG. 2 is a schematic illustration of a print head for Drop-On-Demand (DOD) thermal printing.

Drop on Demand (DOD) printing involves ejecting ink only when required, and may take two forms: piezoelectric and thermal, as shown by FIG. 1 and FIG. 2, respectively. With reference to FIG. 1, a schematic illustration of a print head 100 of a drop on demand (DOD) inkjet printer is shown. Print head 100 prints onto a substrate 102 in response to receiving an incoming signal 104 to do so. Print head 100 consists of a piezoelectric crystal 106 such as zirconium titanate, for example, and an ink reservoir 108, equipped with a nozzle or droplet orifice 110. For printing onto a substrate 102, the nozzle 110 is typically positioned close to the substrate 102. An incoming signal 104 applies a voltage pulse across the piezoelectric crystal 106, changing its size. This applies a pressure to the ink reservoir 108 and forces a droplet 112 of ink through orifice 110 onto the substrate 102.

With reference to FIG. 2, in an alternative drop-on-demand (DOD) technology, a print head 200 of a thermal DOD inkjet printer is shown. Thermal print head 200 prints onto a substrate 102 in response to an incoming signal 104, and comprises an ink reservoir 108, a nozzle or droplet orifice 110, through which droplets 112 of ink are forced, mutatis mutandis. However, instead of a piezoelectric crystal 106, a heat source 114 is provided. In response to receiving a signal, ink in ink reservoir 108 is heated by heat source 114. The rapid heating causes vaporization and expansion, forming a bubble within the ink reservoir 108. The bubble triggers a fluid-pressure impulse, ejecting a droplet 112 from the nozzle 110.

In general, either a droplet of ink is ejected or is not ejected. The drop/no drop arrangement enables monochromatic printing to be achieved.

Where an array of droplets is deposited, by either applying or not applying a droplet to some of the points of the array, grayscale, or intermediate densities of coverage are created.

Embodiments of the present invention are described hereinbelow with reference to the figures.

Aspects of the present invention are directed to an improved method of printing with a drop-on-demand inkjet print head 100, 200 such as of the types shown in FIGS. 1 and 2, comprising a volume of ink in a container 108 having an orifice 110 and an ejecting means such as a piezoelectric transducer 106 (FIG. 1) or a heating element 114 for ejecting droplets 112 of ink through the orifice 110.

In general, drop on demand (DOD) inkjet printing carefully controls the size of droplets ejected. A carefully controlled electronic signal applies a specific heating effect to the heating element 114 of the thermal drop on demand print head, or a specific voltage across a piezoelectric transducer 106 induces a specific volume change. Both techniques create a specific pressure in the ink in the fixed volume container 108 and thereby eject a carefully controlled, standard sized droplet 112.

Counter intuitively and against the whole thrust of drop on demand inkjet printing which carefully ensures that all droplets are in a narrow distribution of sizes, aspects of the present invention are directed to an improvement consisting of selectively ejecting droplets of more than one size.

Figure 3:
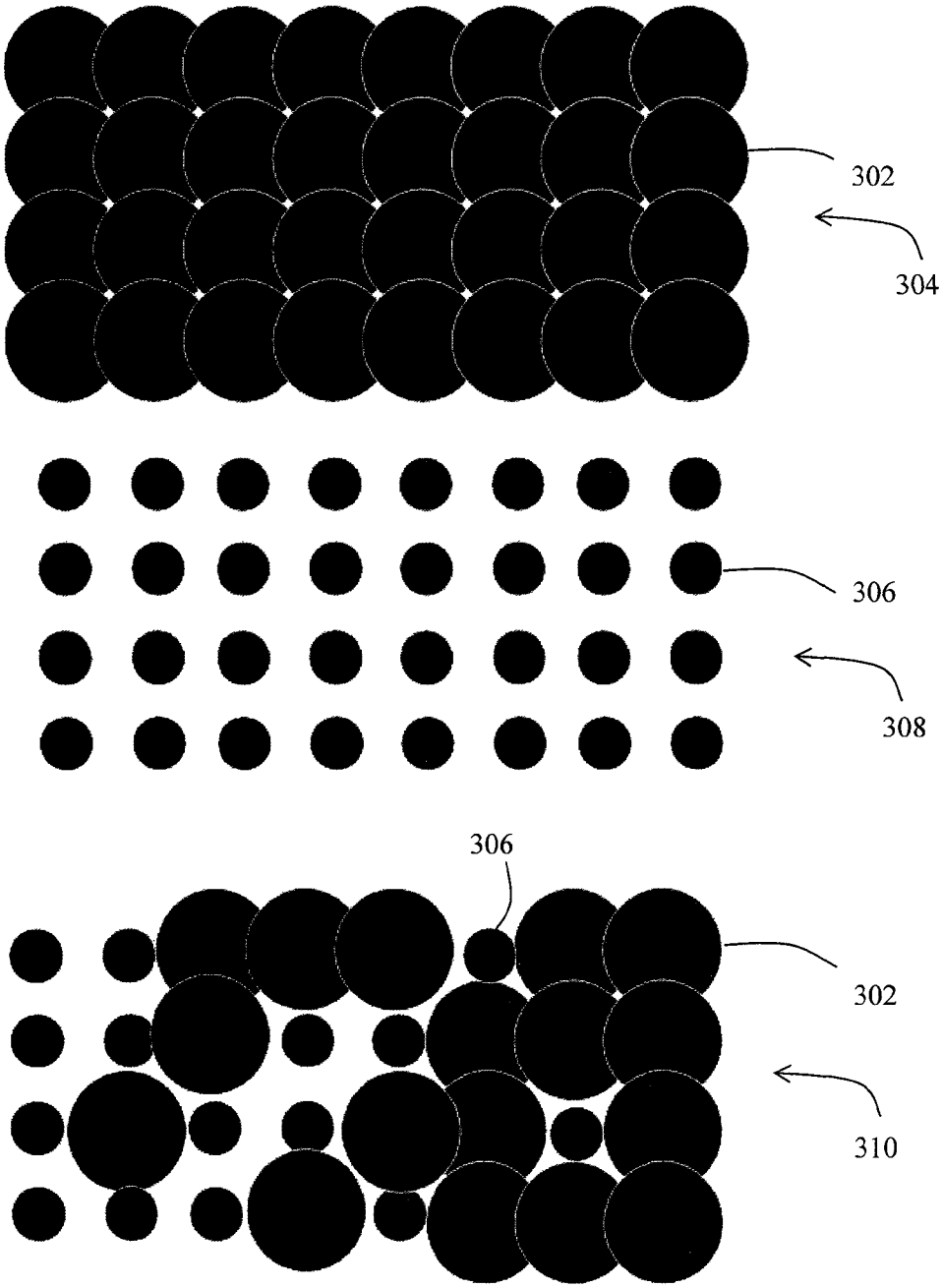
FIG. 3 illustrates how different grey level densities may be realized using droplets of two drop sizes.

With reference to FIG. 3, depositing an 8×4 array of droplets of a first droplet size 302 allows a first printing density 304. Depositing an 8×4 array of droplets of a second droplet size 306 allows a second printing density 308.

Both the first printing density 304 and the second printing density 308 comprise coverage of the medium by an 8×4 array of droplets. Nevertheless, the printing density is different, since the size of the first droplets 302 is significantly larger than the size of the second droplets 306.

Both coverage 304 and coverage 308 may be created by the same inkjet head with the same droplet size, where the ink absorption characteristics of the medium being printed vary.

In addition to the freedom of traditional inkjet printing of depositing or not depositing a droplet of ink at any point of the array, aspects of the present invention allow additional degrees of freedom by allowing more than one size of droplet to be ejected.

This enables additional grayscale, or printing densities to be obtained, where the coverage in terms of drops per unit area (e.g. drops per inch) stays the same.

By way of example, 310 is a further 8×4 dot array but comprising both first drop sizes 302 and second drop sizes 306.

It will be appreciated that applying different drop sizes via a common print head may be used in conjunction with traditional methods of varying the printing intensity by varying the number of droplets deposited on a given area.

In some methods of the invention, the size of the droplet ejected by the print head may be varied selectively by applying one of a plurality of voltage signals to the ejecting means for applying one of a plurality of ejecting pressures for ejecting one of a plurality of drop sizes.

Typically two drop sizes 302, 306 will be selectively deposited.

Referring back to FIG. 1, where the ejecting means comprises a piezoelectric transducer 106 it has been surprisingly found that instead of using a single voltage signal for creating a single shape change, a plurality of voltage signals may be supplied for inducing a plurality of shape changes to the piezoelectric transducer 106 for ejecting one of a plurality of droplet sizes.

Similarly, with reference to FIG. 2, where the ejecting means comprises a heating element 114, instead of applying one signal 104 to induce one current pulse in the heating element 114 for creating one raised ink pressure for ejecting one droplet size 112, a plurality of voltage signals may induce a plurality of current pulses and eject a plurality of droplet sizes.

The signal 104 applied to the print head 100 (200) of conventional inkjet printing is carefully controlled and standardized, and the size of the droplet 112 ejected by the inkjet printer is thereby carefully controlled and standardized. More accurately, since every drop is slightly different, a narrow range of droplet sizes is produced.

It has been found that by supplying a second voltage pulse instead of the first voltage pulse used for forcing a first droplet size through the orifice 110, a second droplet size may be created, and this will create a second dot size on the print medium.

In this manner, instead of a simple leptokurtic narrow Gaussian size distribution, a bimodal size distribution may be created.

Figure 4:
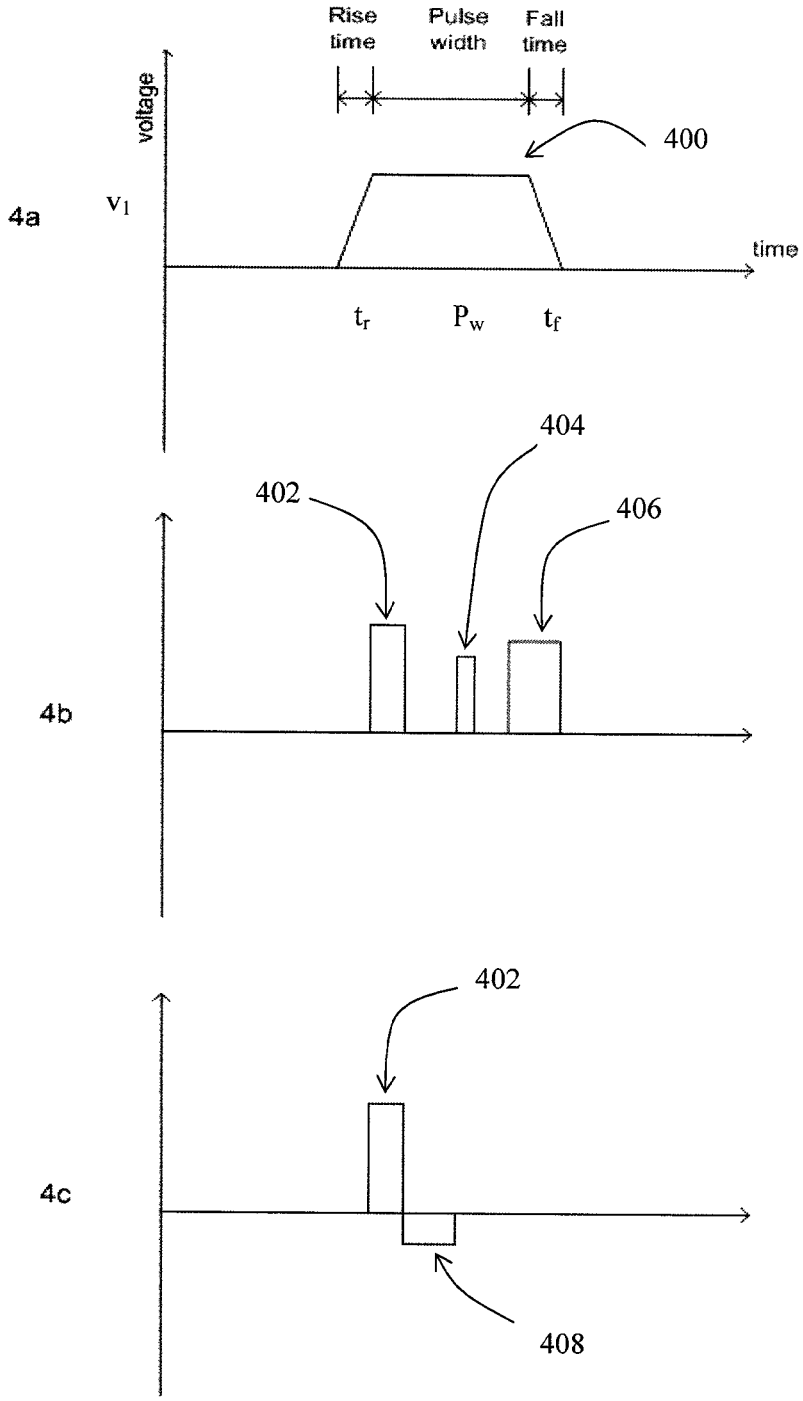
FIGS. 4*a* to 4*c* shows examples of how various signal shapes may be used as driving signals to drive different size ink droplets through print heads wherein the shape and of the signal control the drop sizes.

With reference to FIG. 4*a*, a voltage pulse 400 on a voltage-time graph is shown.

In general, a voltage pulse has a voltage size vls and a duration that comprises the pulse width Pw and a rise time tr and fall time ff.

With reference to FIG. 4*b*, a voltage pulse on a voltage-time graph may comprise a number of smaller pulses 402, 404, and 406. It will be appreciated that supplying voltage pulse 400 or smaller pulses 402, 404, 406 together, to an inkjet print head 100 (200) may be essentially equivalent. However, if the small pulses 402, 404, 406 taken together, have a different duration or average voltage, for example, the overall effect may be very different.

To create a second voltage pulse, the second signal may be supplied instead of the first signal, as a substitute signal for creating a substitute pulse, or may be supplied in addition to the first signal, adding to the first signal and creating a second pulse size.

Where both the first and second signals have the same polarity, the applying a second signal in addition to the first signal will create a larger shape change in the piezoelectric transducer 106 of a piezoelectric drop on demand print head 100, or an increased power in the heating element 114 of a thermal drop on demand print head 200.

With reference to FIG. 4*c*, in addition to a first signal 402, a second signal 408 may have a reversed polarity to the first signal. The overall voltage supplied to the piezoelectric transducer 106 of a piezoelectric drop on demand print head 100 will be less and the resulting shape change will be less, or the overall current in the heating element 114 of a thermal drop on demand print head 200 will be less. In both cases, the size of the droplet 112 ejected through the orifice 110 will be smaller.

Thus by supplying a second signal to the print head 100 (200), whether in addition to or instead of the first signal 104, a different drop size may be ejected.

By supplying effectively two different signal sizes to a print head, two different drop sizes may be ejected. This creates a further way of increasing the dynamic range, in addition to varying the number of drops deposited per unit area.

Although described with reference to a single print head for printing a single color of ink, it will be appreciated that an inkjet printer may further comprise a second print head for printing a second color of ink such that the inkjet printer may be configured to print two colors. Both print heads may receive (two or more) signals, individually or superimposed to eject two (or more) droplet sizes for printing two (or more) dot sizes.

Similarly, in another embodiment, the inkjet printer may further comprise a third print head for printing a third color of ink such that the inkjet printer is configured to print three colors, such as yellow, magenta and cyan, for example.

In yet another embodiment, the inkjet printer may further comprise a fourth print head for printing a fourth color of ink such that the printer is configured to print yellow, magenta, cyan and black, for example.

Optionally, the first inkjet print head may be configured to selectively eject a first drop size on rastering from left to right across the medium and to selectively eject a second drop size on rastering from right to left across the medium.

One application where being able to print with different droplet sizes is invaluable is with wide format and extra wide format inkjet printers. Wide format and extra wide format inkjet printers are generally purchased for printing wide format and extra wide format media, such as posters, signs and wall decorations. For such applications, a resolution of printing with a relatively small number of dots per inch is generally required, as large displays are typically viewed from a distance.

However, increasingly, quality wide format printers may be used for printing several narrower print jobs, such as A4 or even A5 sized pages at the same time. The separate print jobs may be different pages of a book, or may be totally different projects for different clients. It may therefore be desirable to print high resolution images for close viewing despite using a wide format or very wide format printer. Furthermore, it is sometimes desirable to print high resolution and less high resolution images in parallel, using different parts of the width of a wide format or very wide format printer. For example, it may be desirable to print an A1 or A2 poster, designed for viewing from 3 to 5 meters away using part of the width of a wide format printer, and a series of smaller, say 10 cm×15 cm photographic images, using a different part of the print table.

Hitherto, it has not generally been feasible to print two such different printing projects in parallel, or the poster has been printed much slower than would otherwise be required, often to an unnecessarily high resolution and/or the photographs have been printed to an undesirably low resolution.

Figure 5:
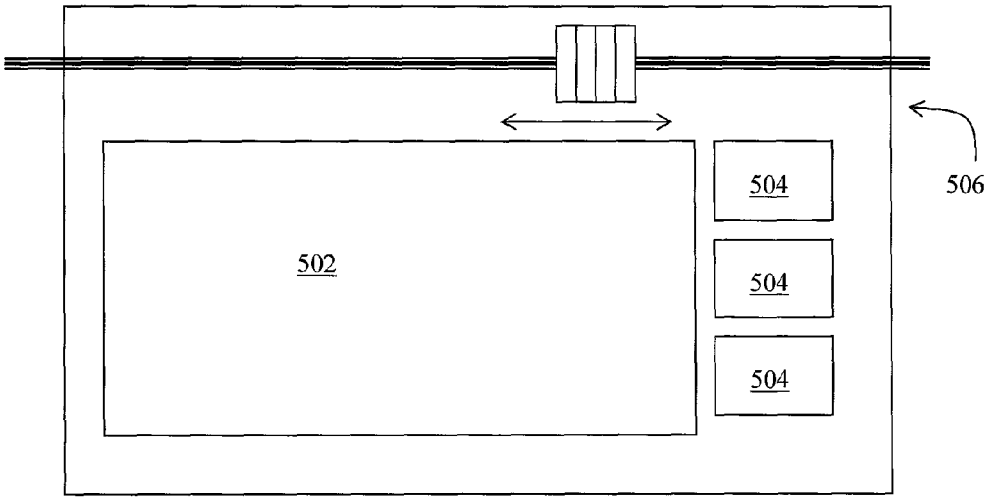
FIG. 5 shows a wide format printer used to print different print jobs in parallel, such as a large poster with a low resolution and photographic images with high resolution.

With reference to FIG. 5, in an embodiment of the present invention, different drop sizes may be printed in different areas, using a large drop size for a poster 502 and a small drop size for photographs 504 printed in parallel therewith using a wide format printer 506. Typically using the same print heads, but alternatively using different print heads on the same carriage. In this manner, acceptable print qualities can be achieved with high throughput, merely by varying the drop size.

Figure 6:
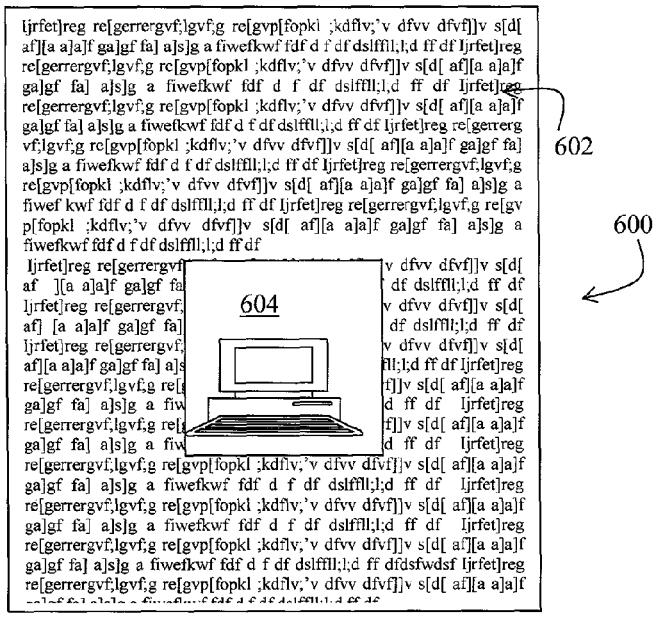
FIG. 6 shows how different regions of a single print job may include areas such as text that may be quickly printed with large drop sizes, and other areas, such as graphics, that may require higher resolution printing.

With reference to FIG. 6, in another application, a page 600 containing text 602 with an embedded image 604 may be printed, using a large drop size for the text 602 and a small drop size for the image 604. The text 602 and image 604 may both be printed in black ink, for example. If the image 604 is a tinted engraving, for example, one could envisage a scenario where in the same area of the image 604, black could be printed with a coarser (large) drop size, and coloring with a finer (small) drop size, perhaps with the coloring or shading using four color ink and finer black droplets of a smaller size. In general, therefore, to attain a printed image including both light and dark regions, while retaining dense darker areas it may be useful to be able to deposit droplets of different size.

An aspect of the present invention relates to a method of inkjet printing that enhances the dynamic range (also known as grey levels) of the printed image.

Referring back to FIG. 3, the theoretical location of 30 pL (pico liter) drops which form ~90 micron dots 302 is schematically shown, such that the area 304 is printed at a resolution of 400×400 dpi.

In contrast, the theoretical location of 10 pL (picoliter) drops, which form ~50 micron dots 306 is shown for printing at the equivalent of a higher resolution, say 400×800 dpi, despite region 308 having the same number of dots per area as region 304. Region 310 of intermediate density is made by printing two dot sizes 302, 306 using two droplet sizes in combination, showing how it is possible to obtain high printing speeds with grey level ability.

Thus it will be appreciated that the variable droplet size of the invention increases the range of grayscale available for a single orifice size.

Although described hereinabove with respect to regular printing of black or colored inks onto a medium, it will be appreciated that the same technique may be used for other inkjet applications, such as rapid prototyping by printing polymers and for printing conductive inks for electronic applications.

In rapid prototyping, a prototype body is built up by printing and curing different layers of polymer to build up a 3 dimensional structure. Selecting different drop sizes for different layers, or for different regions within the same layer according to requirements such as resolution, thickness and width of elements, or large droplet size for inner parts of bulk areas and finer droplet size for external features, enables a generally increased printing speed for the overall printing of the model, while maintaining fine details required for certain elements within the model. Furthermore, it is also not uncommon to combine several models in the same print run to better utilize the entire tray. As with wide format printing described above, in, this case, some of the models requiring finer details, may utilize smaller drops, while others of a more rough nature, may be quickly generated using larger drops. In the preparation stage of the printing of such trays in 3 dimensional printing, the files for each layer are separated to the designated drop sizes based on rules that are defined prior to converting from vector to raster while there is still an understanding of the object characteristics such as the thickness of elements, which pixels are preferable on the outer side of the model, rendering a smoother surface for them.

In yet other applications, electronic circuits may be printed using two different drop sizes, where, for example, width thickness and resolution control can be readily achieved with a small drop size where necessary, and to print thin conductive lines for example, where a larger drop size is used for printing thicker lines.

Thus, the signal pulse for printing may be exploited to optimize the quality for some areas and to optimize the printing speed in other areas where less attention to detail is required.

It will be appreciated by persons skilled in the art that the disclosed technique is not limited to what has been particularly shown and described hereinabove. Rather the scope of the disclosed technique is defined only by the claims, which follow.

The invention claimed is:

1. A method of improved grey-scale printing using a drop-on-demand digital printer to print an ink of a first color onto a medium, comprising selectively providing a first signal to a first orifice to selectively eject a first size droplet of the ink of the first color on rastering from left to right across a medium and selectively providing a second signal to said first orifice to selectively eject a second size droplet of the ink of the first color on rastering from right to left across the medium wherein the first size droplet varies over a first size distribution and the second size droplet varies over a second size distribution, such that the distribution of droplet sizes is bimodal.

2. The method of claim 1 wherein the inkjet printer comprises three print heads for printing three colors of ink such that said inkjet printer is configured to print three colors.

3. The method of claim 2 wherein each of said three print heads is configurable to eject a droplet of a first size when scanning from right to left and to eject a second size droplet when printing from left to right.

4. The method of claim 2 wherein the three colors are yellow magenta and cyan.

5. The method of claim 2 wherein the inkjet printer further comprises a fourth print head for printing a fourth color of ink such that said inkjet printer is configured to print yellow, magenta, cyan and black.

6. The method of claim 1 wherein a print head comprises a piezoelectric transducer configured to selectively apply pressure to a volume of a first color of ink in a first container for forcing ink through the first orifice; the method comprising selectively applying a first signal comprising a voltage pulse to the piezoelectric transducer to selectively eject a first drop having a first droplet size when scanning from left to right, and selectively applying a second signal for applying a second transformation to the piezoelectric transducer, thereby ejecting a second droplet size via the same orifice when scanning from right to left.

7. The method of claim 6 wherein the first signal is a first voltage deviation and the second signal is a second voltage deviation superimposed on the first voltage deviation, such that either the second voltage deviation has a reversed polarity to the first voltage deviation and the second drop size is smaller than the first drop size, or the second voltage deviation has a common polarity with the first voltage deviation and the second droplet size is larger than the first droplet size.

8. The method of claim 1, wherein the first print head comprises a heating element configured to selectively vaporize and thus apply pressure to the volume of a first color of ink in a first container for forcing said first color of ink through the first orifice; the method comprising selectively applying a first signal to selectively eject the first droplet having the first droplet size on rastering from left to right, and selectively ejecting a second droplet of a second droplet size through the orifice by applying a second signal on rastering from right to left.

9. The method of claim 8 wherein the first signal is a first voltage deviation applied to the current supplied to the heating element and the second signal is a second voltage deviation superimposed on the first voltage deviation such that either the second voltage deviation has a reversed polarity to the first voltage deviation and a smaller current is supplied to the heating element and the second droplet size is smaller than the first drop size, or the second voltage deviation has a common polarity with the first voltage deviation and a larger current is supplied to the heating element and the second droplet size is smaller than the first droplet size.

10. The method of claim 1 wherein the drop on demand inkjet printer is either a wide format inkjet printer or an extra wide format inkjet printer.

11. The method of claim 1 wherein different drop sizes are applied to different areas of the medium being printed.

12. The method of claim 1, wherein different print heads on a common carriage are configured to eject different droplet sizes.

13. The method of claim 1 wherein the ink is a photosensitive polymer.

14. A drop on demand digital printer comprising a processor coupled to a print head for providing signals to said print head to eject ink from said printhead through an orifice, said drop on demand printer configured to eject a first sized droplet from the orifice of the print head on scanning from right to left, and a second different sized droplet from the orifice on scanning from left to right.

* * * * *